US005722037A

United States Patent [19]

Chung et al.

[11] Patent Number: 5,722,037

[45] Date of Patent: Feb. 24, 1998

[54] PROCESS FOR PRODUCING TI/TIC COMPOSITE BY HYDROCARBON GAS AND TI POWDER REACTION

[75] Inventors: Hyung-Sik Chung; Yong-Jin Kim; Byung-Kee Kim, all of Kyungsangnam-do, Rep. of Korea; Jian-Qing Jiang, Nanjing, China

[73] Assignee: Korea Institute of Machinery & Materials, Rep. of Korea

[21] Appl. No.: 647,319

[22] Filed: May 9, 1996

[51] Int. Cl.[6] ..... B22F 3/12

[52] U.S. Cl. ..... 419/45; 419/38; 419/48; 419/49; 419/50; 419/51; 419/54; 419/60

[58] Field of Search ..... 419/38, 45, 49, 419/50, 51, 48, 54, 60

[56] References Cited

U.S. PATENT DOCUMENTS

| | | | |
|---|---|---|---|
| 3,615,381 | 10/1971 | Hammond et al. | 75/213 |
| 4,808,372 | 2/1989 | Koczak et al. | 420/457 |
| 4,938,798 | 7/1990 | Chiba et al. | 75/230 |
| 5,429,793 | 7/1995 | Ong et al. | 419/45 |

OTHER PUBLICATIONS

T. Watanabe et al., "Mechanical Properties of Hot–Pressed $TiB_2$–$ZrO_2$ Composites", 68 *Journal of the American Ceramic Society* C–34 (1985).

S. Torizuka et al., "Effects of $ZrO_2$ Addition of the Mechanical Properties of $TiB_2$ HIP'ed Compacts", 100 *Journal of the Ceramic Society of Japan* 259–265 (1992).

C.S. Montross, "Relationships of Tetragonal Precipitate Statistics with Bulk Properties in Magnesia–Partially Stabilized Zirconia", 11 *Journal of the European Ceramic Society* 471–480 (1993).

J. Matsushita et al. "Sinterability and Fracture Toughness of $TiB_2$–$ZRO_2$ Composites by Pressureless Sintering", 37 *Journal of Powder and Powder Metallurgy* 69–73 (1990).

S. Khatri et al. "Formation of TiC in *in situ* processed composites via solid–gas, solid–liquid and liquid–gas reaction in molten Al–Ti", A162 *Materials Science and Engineering* 153–162 (1993).

D. Hu et al., "Coarsening of TiC particles in a rapidly solidified Ti6A14V–TiC composite", 209 *Journal of Alloys and Compouds* 167–173 (1994).

*Primary Examiner*—Charles T. Jordan

*Assistant Examiner*—Daniel Jenkins

*Attorney, Agent, or Firm*—Adduci, Mastriani & Schaumberg, L.L.P.

[57] ABSTRACT

There is provided a process for producing titanium composite, comprising the steps of: molding titanium powder, titanium alloy powder, or powder comprising titanium into a certain shape by a cold isostatic press or cold press; reacting the shape with hydrocarbon gas at its decomposition temperature or higher, to form TiC therein; and providing the shape with high density by vacuum sintering, hot isostatic pressing, hot forging, hot rolling and/or the combinations thereof. TiC a reinforcing material, is in-situ formed by reacting a cold-pressed body of the powder with hydrocarbon gas and cleaner than the externally added one and distributed more uniformly and finely in the Ti matrix, leading to a significant improvement in wear resistance and high temperature property.

8 Claims, 6 Drawing Sheets

700°C

750°C

850°C

PROCESS FOR PRODUCING TI/TIC COMPOSITE BY HYDROCARBON GAS AND TI POWDER REACTION

BACKGROUND OF THE INVENTION

1. Field of the Invention

The present invention relates to a process for producing titanium/titanium carbide composite wherein a certain amount of titanium carbide is in-situ formed in titanium powder-molded body by reacting titanium powder with hydrocarbon gas.

2. Description of the Prior Art

Titanium alloys are widely used for those which require a combination of specific stiffness, strength and corrosion resistance, including aircraft, components, medical implants, chemical equipments and the like, in virtue that it is high in the ratio of stiffness to specific gravity, highly resistant to corrosion and superior in high temperature properties to other metals.

To better improve the mechanical properties of conventional titanium, especially, high temperature strength and wear resistance, titanium composites have been developed via various processes. The present invention is to provide one such process for producing titanium composites.

With reference to FIG. 1*a*, there is shown a conventional process for producing titanium composite using powder. As shown in FIG. 1*a*, titanium or titanium alloy powder and reinforcing powder are first mixed. The mixture is cold-molded, to give it a shape which is, then, subjected to vacuum sintering and hot isostatic pressing, in sequence, to yield an article.

This conventional process, however, has some difficulties in many aspects. For example, it requires the use of titanium carbide, a very expensive material. Further, as the amount of titanium carbide increases, it is more difficult to obtain homogeneous mixture between titanium carbide and titanium alloy powder and its moldability is seriously degraded. The aftermath of these disadvantages results in a density insufficient to allow the canless hot isostatic pressing after the sintering step. In addition, since the used titanium carbide usually has surface contamination and polycrystallinity, crack initiation can occur at or along the reinforcing particle, when subjected to high stress.

In contrast to the conventional process, the present invention does not employ the mixing step of reinforcing powder. Referring to FIG. 1*b*, there is shown a process for producing titanium composite, according to the present invention. As shown in this figure, titanium or titanium alloy powder is cold-molded into a desired shape which is subsequently heated under a hydrocarbon atmosphere, such as methane ($CH_4$) gas or butane ($C_4H_8$) gas to react titanium with the hydrocarbon gas, thereby generating titanium carbides which serve as reinforcing powders. Thereafter, sintering and hot isostatic pressing steps are, in sequence, carried out to obtain the desired article. Since the present invention, as described, utilizes dispersing strengthening powders formed in situ by the reaction with hydrocarbon rather than one additionally mixed, more homogeneous, finer and cleaner monocrystalline titanium carbide can be obtained. Moreover, the amount and size of titanium carbide formed can be controlled by modulating the amount of gas, reaction temperature and retention time in the atmosphere.

SUMMARY OF THE INVENTION

It is a principal object of the present invention to overcome the above problems encountered in prior arts and to provide a process for producing titanium/titanium carbide composite through a in-situ reaction of titanium or titanium alloy powder with hydrocarbon gas.

The process of the present invention consists largely of a first step of molding titanium powder into a shape, a second step of reacting the molded shape with hydrocarbon gas to form titanium carbide inside the shape, and a third step of subjecting the resultant molded shape to vacuum sintering and hot isostatic pressing, in sequence.

In the first step, Ti or its powder is molded into a desired shape, using a press or a cold isostatic press. This step is typical of powder metallurgy process, which is requisite to the article production. In the case of Ti and its powder, sponge titanium powder which can be cold-pressed is usually used. The relative compact density or relative green density of the molded body should be more than 80%, in consideration of pore distribution and sintering property.

The second step is to form fine and homogeneous TiC particles inside the molded body by heating it under a hydrocarbon gas atmosphere, such as methane ($CH_4$) or propane ($C_3H_8$), in a furnace, at higher than the decomposition temperature of the hydrocarbon gas into carbon and hydrogen. In principle, when hydrocarbon gas is heated at higher than its decomposition temperature into component elements, carbon is generated, —which then partially—penetrates into the molded body to react with Ti, thereby forming TiC. Accordingly, the amount of TiC formed in the molded body is varied with the amount of hydrocarbon decomposed and the flow rate and kind of hydrocarbon. Consequently, a desired amount of TiC can be formed by modulating these variables adequately, Enhanced mechanical properties and high density are made to the molded body in the third step. Since the molded body provided from the second step generally has the same density with the compact density and is insufficient in the bonding strength between powder particles, sintering at high temperature is made so as to enhance stiffness and density, followed by hot isostatic pressing or hot forging for removing residual pores. The sintering is carried out under a high vacuum condition less than $10^{-5}$ torr at the temperature and time which are selected so that the relative sintered density should be on the order of 93–94% to have closed pores. Following sintering, hot isostatic pressing without canning may be performed to remove the closed pores from the sintered body or, if necessary, hot forging or hot rolling may be made thereto. This step is a known process of powder metallurgy.

The titanium composite processed through the above three steps may be further subjected to other processes, for example, thermal treatment or surface coating, in order to more improve physical properties.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Figure 1A:
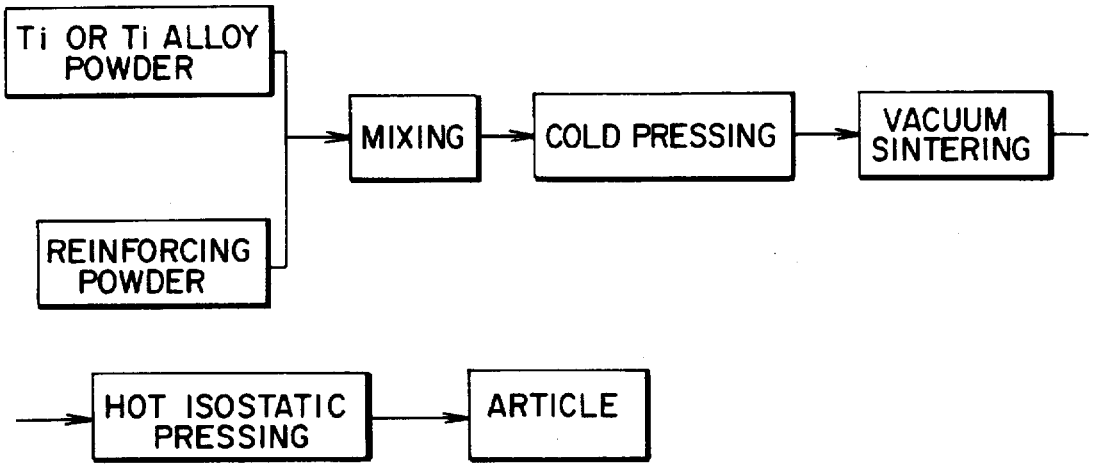
FIG. 1*a* is a block diagram showing a conventional process for producing titanium composite from powder.
Figure 1B:
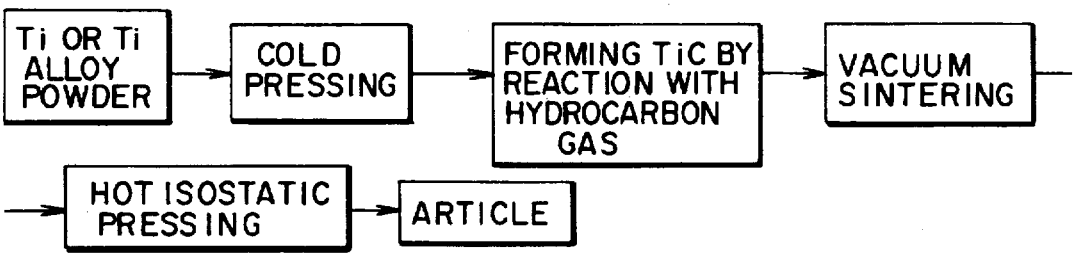
FIG. 1*b* is a block diagram showing a process for producing titanium composite, according to the present invention.

The present invention is to provide an in-situ process for producing titanium carbide-reinforcing composite wherein titanium or titanium alloy powder is subjected to pressing and then, reacted with hydrocarbon gas to form titanium carbide.

According to the conventional mixing process for titanium composite, titanium or its alloy powder, and a reinforcing material, such as carbides, nitrides and borides, are mixed at a constant ratio and subjected to pressing, sintering and hot isostatic pressing, in sequence. A significant problem of the conventional process is that, after cold pressing, the green density becomes low as the amount of the reinforcing materials increases. This is attributed to the fact that the reinforcing materials, carbides, nitrides or borides, are high in hardness but low in ductility. In addition, such reinforcing materials have a tendency to segregate and produce poor density distribution within the pressed body and, in some cases, cause cracks. Moreover, since the low green density and nonuniform density distribution restrain the density increase upon sintering, it is impossible to obtain a relative sintered density of 93–94%, a density allowable to operate well-known canless hot isostatic pressing.

In contrast, the present invention uses pure Ti or Ti alloy powder alone as the starting material. In the absence of such reinforcing materials, Ti or Ti alloy powder alone is of better moldability than the mixture thereof. TiC, a reinforcing material, is in-situ formed by reacting a cold-pressed body of the powder with hydrocarbon gas. Accordingly, there are no problems, such as poor moldability, nonuniform density distribution or cracks in the present invention. Furthermore, a large amount of TiC can be formed in the Ti matrix by controlling the reaction conditions, in accordance with the present invention. In particular, since Ti powder can be molded in a cold isostatic press or a press, by virtue of better moldability, complex-shaped parts are produced without intermediate processing steps, in accordance with the present invention. The TiC formed by the reaction with hydrocarbon gas is cleaner than the externally added one and distributed more uniformly and finely in the Ti matrix, leading to a significant improvement in wear resistance and high temperature properties.

A description will be, in detail, given for the in-situ process, below.

In accordance with the present invention, both pure titanium/titanium carbide composite and titanium alloy/titanium carbide composite can be produced. In the former case, titanium powder is molded using a cold press in such a way that the relative green density should be above 80%. For titanium alloy/titanium carbide composite, titanium powder is further added to the titanium alloy powder in an amount equal to the Ti weight in the titanium carbide to be formed. This is because it is very important to keep the alloy components Of matrix constant.

In order to react with hydrocarbon gas, the molded titanium or its alloy is fed into a furnace which is equipped with a hydrocarbon gas supplier and optionally capable of being vacuumized to an extent of $10^{-5}$ torr or more, and heated therein. The gas supplier is so controllable in pressure and flow rate that the TiC amount to be formed can be regulated. The gas atmosphere in the furnace includes pure hydrocarbon gas alone or in combination with reducing or inert gas, such as $H_2$, $N_2$ and Ar.

With regard to the reaction temperature in the furnace, higher than the decomposition temperature of the hydrocarbon gas into carbon and hydrogen is required, For example, although methane ($CH_4$) gas starts to decompose into carbon and hydrogen at about 500° C., the amount decomposed is insufficient to obtain a desired amount of TiC. Generally, as high as 700° C. is required for methane gas.

While the carbon resulting from such decomposition reacts with the heated Ti to form TiC, the decomposed hydrogen sustains a reducing atmosphere in the furnace, preventing the titanium from being oxidized.

As mentioned above, since the amount, size and distribution of the TiC formed are determined by external parameters including the reaction temperature of the furnace, retention time in the furnace and flow rate of hydrocarbons, the conventional inhibitory factors against the moldability of Ti are removed, in accordance with the present invention. Hence, in contrast to the conventional simple mixing method, the process according to the present invention can incorporate a large amount of TiC.

The chemical reaction formulas for the formation of TiC are illustratively given as follows:

1. TiC formation by methane gas $$CH_4(g) \rightarrow C(s) + 2H_2(g) \quad [I]$$

$$C(s) + Ti(s) \rightarrow TiC(s) \quad [II]$$

2. TiC formation by propane gas $$C_3H_8(g) \rightarrow 3C(s) + 4H_2(g) \quad [III]$$

$$C(s) + Ti(s) \rightarrow TiC(s) \quad [IV]$$

Such in-situ reaction allows nuclei to form and grow to TiC powders which do not show surface contamination and are purer than externally added ones. Also, TiC in-situ formed highly matches with the titanium matrix in addition to being of monocrystallinity.

Sponge titanium powder generally contains chlorine component (Cl) at an amount of about 1,000 to 3,000 ppm. Upon sintering, the component not only restrains the density increase but also decreases the fatigue strength and ductility of the material. In this regard, the hydrogen resulting from the decomposition of hydrocarbon plays a critical role. The chlorine component is reduced by the hydrogen. For example, the hydrogen gas from the formulas I and III reacts with the chlorine impurity, to form hydrogen chloride gas which is evaporated, as shown in the following reaction formula V:

$$H_2(g) + Cl(s) \rightarrow HCl(g) \quad [V]$$

Because the material which has passed through the above processing steps shows a density similar to green density, a sintering step is undertaken to increase the density of the material, to an extent that closed pores alone are present, typically to above 93–94% of net density, thereby making it ready for canless hot isostatic pressing and hot forging.

Usually, the sintering of titanium powder compact is carried out under a low pressure of $10^{-5}$ torr or lower at 1,200° C. or higher temperature. Depending on various variables including the kind of alloy and the elements added, the sintering conditions, such as the sintering temperature and the sintering time in furnace, are selected adequately.

Following the sintering, the closed pores in the sintered body can be removed using a hot isostatic press. In some cases, the body may be subjected to hot forging or hot rolling. Other processing steps including thermal treatment and surface coating, if necessary, may be undertaken, to enhance the physical properties of the resultant titanium composite.

A better understanding of the present invention may be obtained in light of following examples which are set forth to illustrate, but are not to be construed to limit, the present invention.

EXAMPLE I

The moldability of pure Ti powder, a starting material according to the present invention, was compared with that of Ti/TiC mixture. This results are given as shown in Table 1 below. For Ti/TiC mixture, sponge Ti powder, commercially available from Micron Metal, U.S.A., and TiC powder, commercially available from New Materials, Japan, were mixed in a tubular mixer for 30 min. and then, pressed in a single action press with a diameter of 16 mm.

TABLE 1

Relative Density after Cold Pressing

| Kind of Alloy | Pressing Pressure 4 ton/cm² | 5 ton/cm² | 8 ton/cm² |
|---|---|---|---|
| Ti | 75% | 81% | 88% |
| Ti-5 wt % TiC | 75% | 80% | 87% |
| Ti-10 wt % TiC | 74% | 78% | 85% |
| Ti-20 wt % TiC | 71% | 75% | 77% |
| Ti-30 wt % TiC | 69% | 69% | 70% |

*Relative Density (dens. of pressed body/net dens. × 100)

Under a pressure of 5 ton/cm² as shown in Table 1 titanium powder alone is pressed at a relative density of 80% or more whereas the mixtures of Ti/TiC show lower relative densities. Higher TiC content, lower the relative density. This is attributed to the fact that TiC, hard particle, is inhibitory of the moldability. Particularly, more than 20% content of TiC shows a low green density, 77%, even at a high pressure of 8 ton/cm². Such low green density results in a low sintered density in a vacuum-sintered body.

Figure 2:
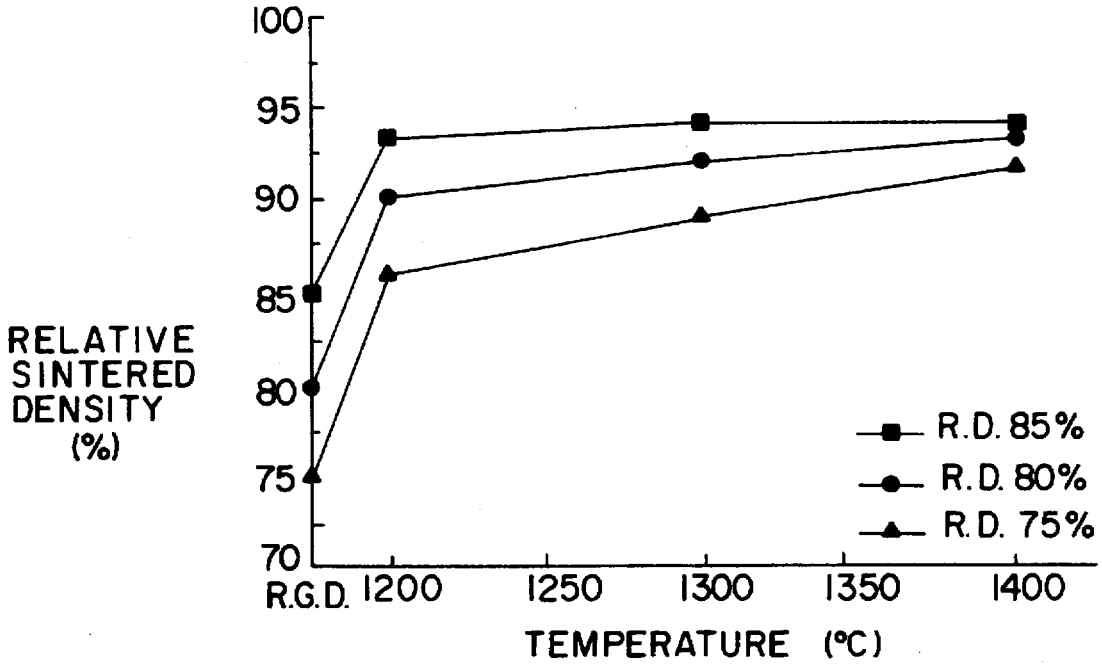
FIG. 2 shows the effect of green density on the sintered density of Ti powder.

FIG. 2 shows the relations between the green density and the sintered density for pure titanium. In this case, titanium powder was first pressed at relative green densities of 75, 80 and 85%. Each of the pressed bodies was sintered at various temperatures under a vacuum of $10^{-5}$ torr or less, with a sintering time of 120 min by temperatures each, after which density measurement was performed. This reveals that the residual pores in the pure titanium sintered can be removed using canless hot isostatic pressing only if the relative green density is at least 80%. However, when TiC powder is included at 20% wt or more, such high green density cannot be obtained by the conventional simple mixing and pressing process. As a result, it is virtually impossible to obtain a high sintered density of 93–94%, above which closed pores alone are present.

In contrast, the present invention employs pure titanium powder alone as starting material, which reduces almost all problems described above.

EXAMPLE II

Premixed powder Ti-6Al-4V, sold by Micron Metal, U.S.A., was pressed in such a way that relative green density was 80%. Then, the pressed body was reacted with methane ($CH_4$) gas at 700°–800° C., to form titanium carbide. This resulting titanium/titanium carbide composite was sintered at 1,300° C. for 4 hours under a pressure of $10^{-5}$ torr, to obtain a relative sintered density of 93% or higher. Because the pores within the sintered sample were found to be closed, a canless hot isostatic pressing was carried out at 950° C. for 4 hours under a pressure of 1,200 bar, to remove the residual pores.

FIG. 3 shows X-ray diffraction patterns of the sintered sample, revealing that titanium carbide is formed by thermally treating the pressed body consisting of the titanium alloy alone with methane gas at 900° C.

The amount of titanium carbide formed is dependent on the reaction temperature and the retention time in the furnace. Using an image analyzer, the change in the amounts of the titanium carbide formed with reaction temperatures were measured at a fixed retention time of 30 min. The results were plotted in FIG. 3. As shown in this figure, the titanium carbide formed amounts to about 10% by volume at about 700° C. and increases to 52% by volume at about 900° C.

Figure 5:
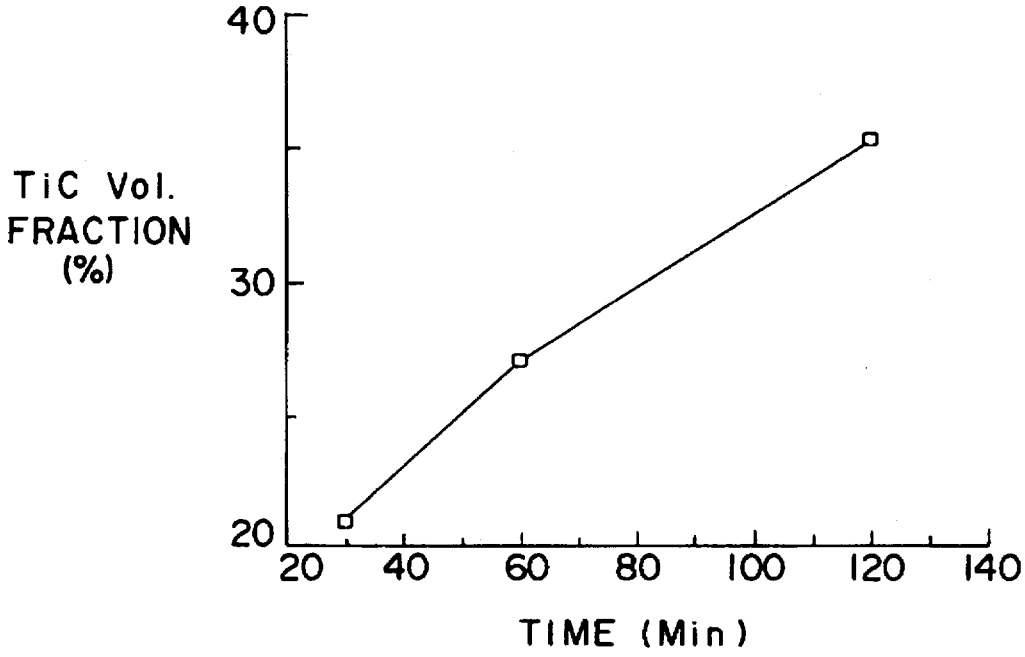
FIG. 5 is a plot showing volume fractions of the titanium carbide formed at various retention times with a constant reaction temperature of 750° C.
Figure 6A:
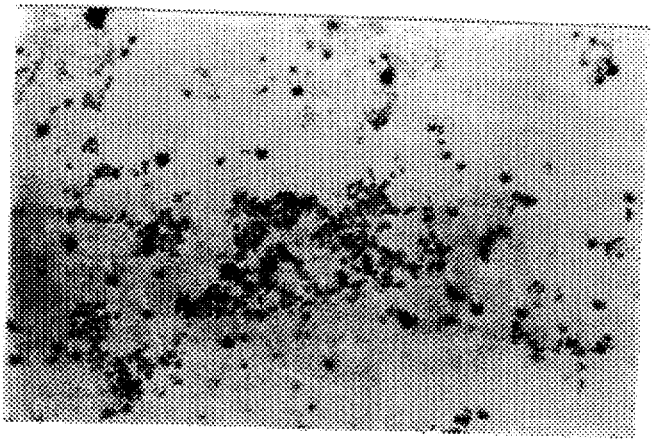
FIGS. 6*a* to 6*c* are photographs showing the structures of samples which are, in sequence, subjected to reaction with methane gas for 30 min at 700°, 750° and 850° C., respectively, vacuum sintering and hot isostatic pressing.
Figure 6B:
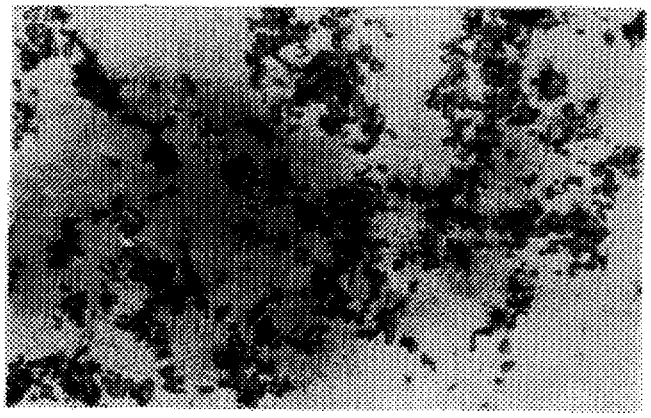
Figure 6C:
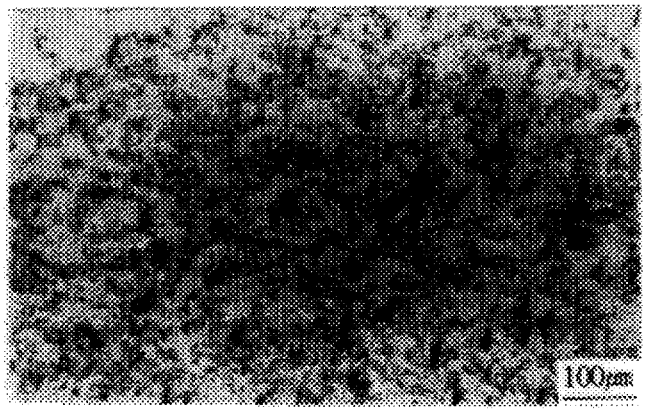

FIG. 5 shows the relation between the amount of titanium carbide formed and the retention time in furnace at a constant reaction temperature, in this case, 750° C. As seen, the amount of the titanium carbide formed is almost directly proportional to the retention time.

From the two above results, it is apparent that the amount of titanium carbide within the titanium composite can be controlled by the reaction temperature with hydrocarbon gas and the retention time in furnace, according to the present invention.

Figure 3A:
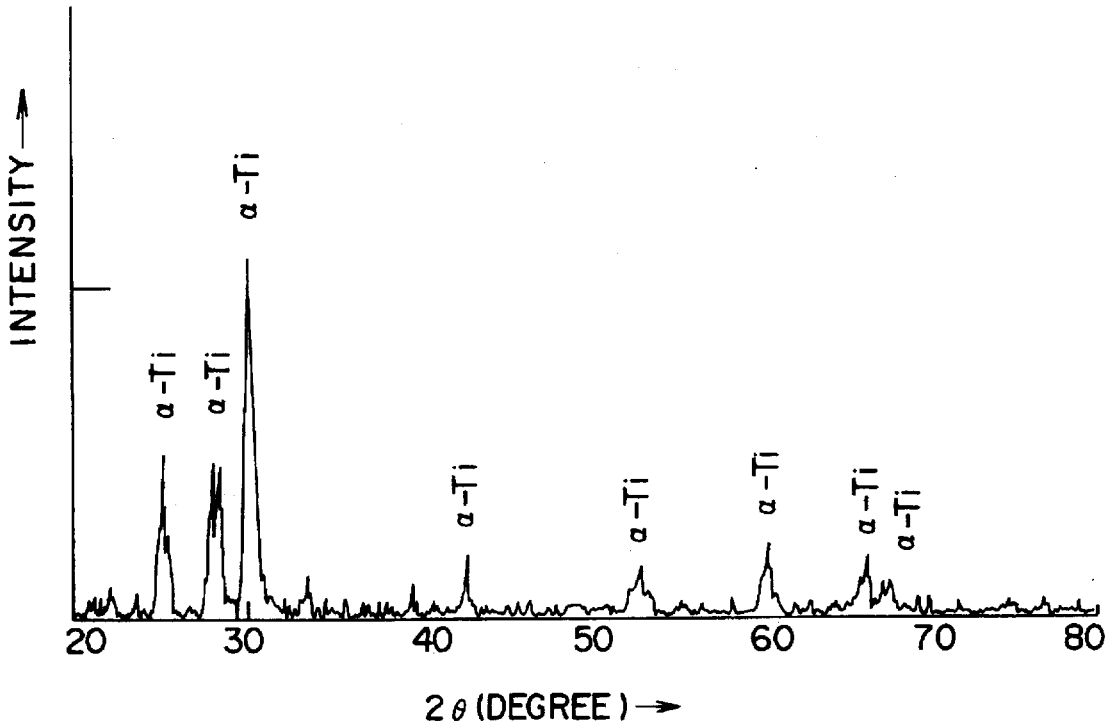
FIG. 3*a* is an X-ray diffraction pattern of a Ti-6Al-4V powder-molded body.
Figure 3B:
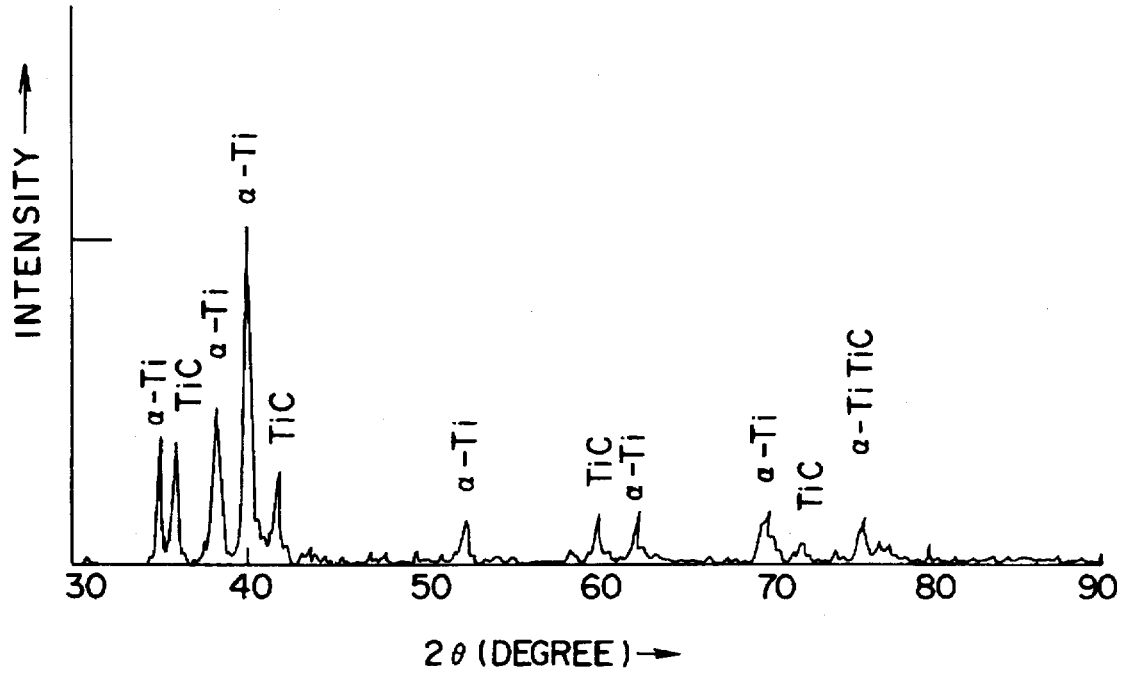
FIG. 3*b* is an X-ray diffraction pattern of the molded body reacted with methane gas at 900° C. for 30 min.
Figure 4:
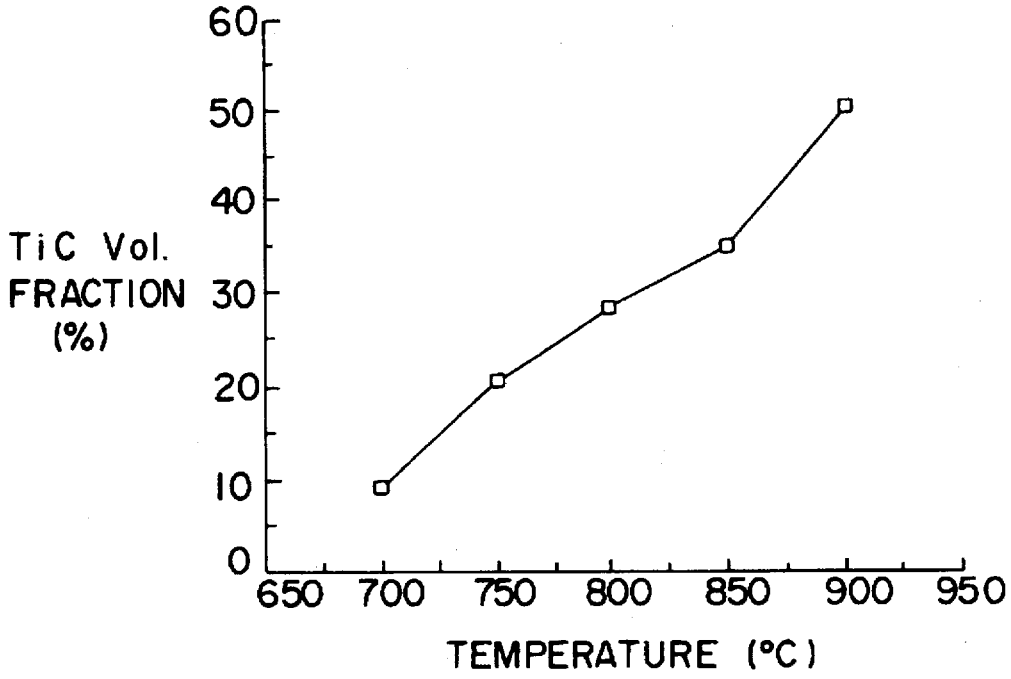
FIG. 4 is a plot showing volume fractions of the titanium carbide formed at various reaction temperature with a constant retention time of 30 min.

Three titanium samples were reacted with methane gas for 30 min at 700°, 750°, and 800° C., respectively, to form titanium carbide, after which sintering was performed at 1,300° C. for 4 hours in vacuo, followed by the removal of the residual pores by use of hot isostatic press. Their structures are shown in FIGS. 3*a* to 3*c*, respectively. At 700° C., the titanium carbide was found to be low in amount and its distribution to be not uniform. Whereas, at 850° C., the titanium carbide is homogeneously formed over the entire sample. Consequently, as the reaction temperature increases, the amount and size of the titanium carbide formed increases.

Figure 7:
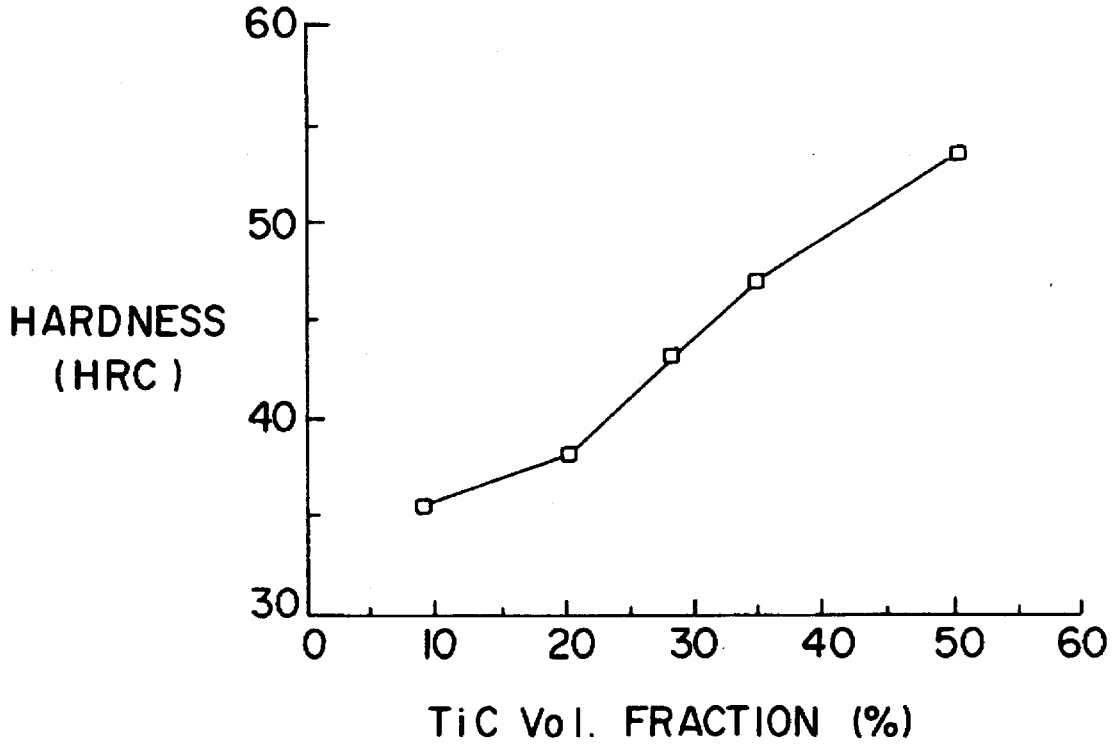
FIG. 7 is a plot showing hardness of a sample which is in sequence, subjected to reaction with methane gas, vacuum sintering and hot isostatic pressing, with regard to the amount of carbide formed.

FIG. 7 shows the relation between the hardness of a titanium composite produced by reaction with methane gas, sintering and hot isostatic press, and the amount of the titanium carbide formed. The hardness increases with titanium carbide.

Meanwhile, the titanium powder had a chlorine component at an amount of about 1,000 ppm whereas the sample produced according to the present invention was found to have 50 ppm.

The present invention has been described in an illustrative manner, and it is to be understood the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described,

What is claimed is:

1. A process for producing titanium composite, comprising the steps of:

molding titanium powder, titanium alloy powder, or powder comprising titanium into a certain shape by a cold isostatic press or cold press;

reacting the shape with hydrocarbon gas at its decomposition temperature or higher, to form TiC therein; and providing the shape with high density by vacuum sintering, hot isostatic pressing, hot forging, hot rolling and/or the combinations thereof.

2. A process in accordance with claim 1, wherein said hydrocarbon gas consists of hydrogen and carbon elements and starts to be decomposed into its elements at its decomposition temperature.

3. A process in accordance with claim 1, wherein said powder is reacted with hydrocarbon gas in a reducing atmosphere, such as $H_2$, or in an inert atmosphere, such as nitrogen and argon.

4. A process in accordance with claim 1, wherein chlorine component included in said powder is removed by the hydrogen gas resulting from the decomposition.

5. A process for producing titanium composite, comprising the steps of:

reacting titanium powder, titanium alloy powder, or powder comprising titanium with hydrocarbon gas at its decomposition temperature or higher, to generate TiC powder; and subjecting the TiC powder to hot isostatic pressing, hot extruding and/or hot rolling.

6. A process in accordance with claim 5, wherein said hydrocarbon gas consists of hydrogen and carbon elements and starts to be decomposed into its elements at its decomposition temperature.

7. A process in accordance with claim 5, wherein said powder is reacted with hydrocarbon gas in a reducing atmosphere, such as $H_2$, or in an inert atmosphere, such as nitrogen and argon.

8. A process in accordance with claim 5, wherein chlorine component included in said powder is removed by the hydrogen gas resulting from the decomposition.

* * * * *